US008961376B2

(12) United States Patent
Sweeney et al.

(10) Patent No.: US 8,961,376 B2
(45) Date of Patent: Feb. 24, 2015

(54) APPARATUS AND METHOD TO STRETCH UPPER AND LOWER EXTREMITIES

(76) Inventors: Mark Sweeney, Bloomingdale, IL (US); Brett Harker, Simpsonville, SC (US)

( * ) Notice: Subject to any disclaimer, the term of this patent is extended or adjusted under 35 U.S.C. 154(b) by 0 days.

(21) Appl. No.: 13/035,693

(22) Filed: Feb. 25, 2011

(65) Prior Publication Data

US 2012/0220435 A1 Aug. 30, 2012

(51) Int. Cl.

| | |
|---|---|
| ***A63B 21/02*** | (2006.01) |
| ***A63B 21/04*** | (2006.01) |
| ***A63B 21/00*** | (2006.01) |
| ***A63B 21/002*** | (2006.01) |
| *A63B 69/00* | (2006.01) |
| *A63B 23/00* | (2006.01) |

(52) U.S. Cl.

CPC ..... *A63B 21/0023* (2013.01); *A63B 21/1442* (2013.01); *A63B 21/1469* (2013.01); *A63B 21/1484* (2013.01); *A63B 21/0442* (2013.01); *A63B 21/1426* (2013.01); *A63B 69/0057* (2013.01); *A63B 2023/006* (2013.01)

USPC ..... 482/124; 482/92; 482/121; 482/129

(58) Field of Classification Search

USPC ..... 482/121, 92, 124, 129

See application file for complete search history.

(56) References Cited

U.S. PATENT DOCUMENTS

| | | | | |
|---|---|---|---|---|
| 2,498,006 | A * | 2/1950 | Ridill | 473/217 |
| 3,752,474 | A * | 8/1973 | Macabet et al. | 482/131 |
| 3,923,050 | A | 12/1975 | Zeide et al. | |
| 4,109,905 | A | 8/1978 | Meier | |
| 4,132,404 | A | 1/1979 | Wilson | |
| 4,245,839 | A * | 1/1981 | Trent | 482/92 |
| 4,398,500 | A * | 8/1983 | Koronkiewicz | 119/793 |
| 4,544,155 | A * | 10/1985 | Wallenbrock et al. | 482/129 |
| 5,308,305 | A * | 5/1994 | Romney | 482/124 |
| 6,110,083 | A | 8/2000 | Riser | |
| 6,338,700 | B1 * | 1/2002 | Pollock | 482/95 |
| 6,551,221 | B1 * | 4/2003 | Marco | 482/74 |
| 6,662,753 | B1 * | 12/2003 | Sporn | 119/797 |
| 7,662,073 | B1 | 2/2010 | Baldwin | |
| 2003/0130098 | A1 * | 7/2003 | Marco | 482/124 |
| 2004/0204302 | A1 * | 10/2004 | Flynn | 482/124 |
| 2007/0213186 | A1 * | 9/2007 | Longo | 482/121 |
| 2010/0062881 | A1 * | 3/2010 | Horkan | 473/439 |
| 2010/0251970 | A1 * | 10/2010 | Dagnon | 119/794 |
| 2011/0028287 | A1 | 2/2011 | Kassel | |
| 2011/0277700 | A1 * | 11/2011 | Friedland | 119/792 |

OTHER PUBLICATIONS

European Patent Office Search Report—Application No. 12156764.8-2318 Dated: Jul. 5, 2012.

* cited by examiner

*Primary Examiner* — Loan H Thanh
*Assistant Examiner* — Shila Jalazadeh Abyane
(74) *Attorney, Agent, or Firm* — Niro, Haller & Niro

(57) ABSTRACT

An arm and/or leg stretching apparatus and method where one end of a steel (or other rigid material) cable can be connected to a post, tree or to anything that it can be wrapped around, and the other end fits a cuff that can be placed around the wrist or ankle so that the user can stretch by leaning or pulling against the cable. An alternate embodiment of the present invention can use a waist belt where again, the user uses his or her own weight to stretch against the cable. In the case of an arm stretch, the cuff relieves the user of having to grip something by attaching around the wrist.

4 Claims, 6 Drawing Sheets

APPARATUS AND METHOD TO STRETCH UPPER AND LOWER EXTREMITIES

BACKGROUND

1. Field of the Invention

The present invention relates generally to exercise and more particularly to an apparatus and method used to stretch the upper and lower extremities.

2. Description of the Prior Art

It is well known that there are many beneficial results from stretching exercises. Such exercises are used by runners, other athletes of all types, and are many times used for rehabilitation. There are many prior art devices that allow stretching including many devices that use weights or bungee cords. Some of these devices require two people in order to perform the exercise.

Riser in U.S. Pat. No. 6,110,083 teaches a transportable stretching system where one limb is stretched by pulling a cable at one end through a pulley. Wilson U.S. Pat. No. 4,132,404 teaches a stand-on device for leg stretching.

It would be advantageous to have an apparatus and method for leg and/or arm stretching that uses only the body's own weight, that was mechanically very simple, needed only one person, was highly portable, and that would support a variety of stretch exercises.

SUMMARY OF THE INVENTION

The present invention relates to an arm and/or leg stretching apparatus and method where one end of a single steel (or other rigid material) cable can be connected to a post, tree or to anything that it can be wrapped around, and the other end fits a cuff that can be placed around the wrist or ankle so that the user can stretch by leaning or pulling against the cable. An alternate embodiment of the present invention can use a waist belt where again, the user uses his or her own body weight to stretch against the cable. In the case of an arm stretch, the cuff relieves the user of having to grip something by attaching around the wrist.

DESCRIPTION OF THE FIGURES

Attention is now directed to several drawings that illustrate features of the present invention.

Several drawings and illustrations have been presented to aid in understanding the present invention. The scope of the present invention is not limited to what is shown in the figures.

DESCRIPTION OF THE INVENTION

Figure 1:
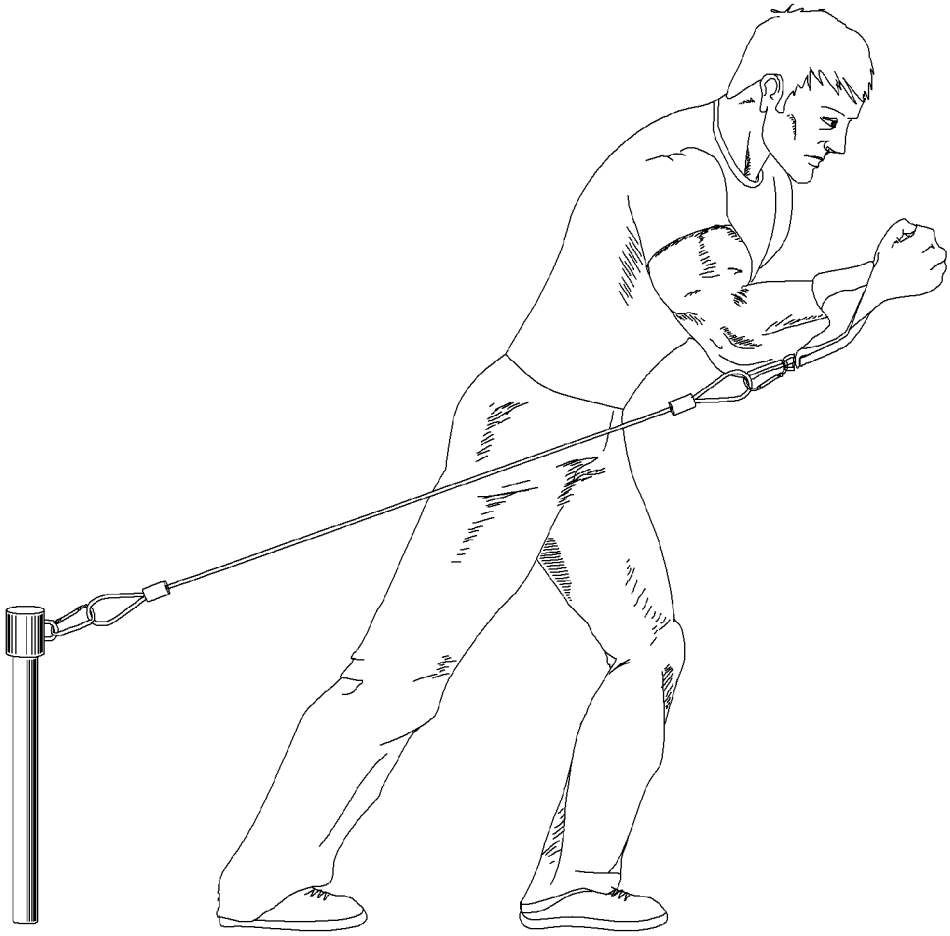
FIG. 1 shows a typical user performing an arm stretch with an embodiment of the present invention.

FIG. 1 shows an embodiment of the present invention in use. One end of a coated cable is tied to, or around, a post of around any secure anchor point available. The anchor point may be a dugout pole, fence post, light pole, wall anchor, door frame with an anchor bolt, or any other anchor point. Any secure anchor point is within the scope of the present invention. The other end attaches to a cuff that fits around the wrist or ankle (or optionally top a waist band). A ring on the cuff slides to tighten the cuff in place. The user uses his or her own body weight to achieve the desired depth of stretch.

The cuff or handle allows the user to relax the intrinsic muscles of the hand, wrist and forearm, or foot, ankle and lower leg while still obtaining a good stretch without having to hold onto something.

Figure 2:
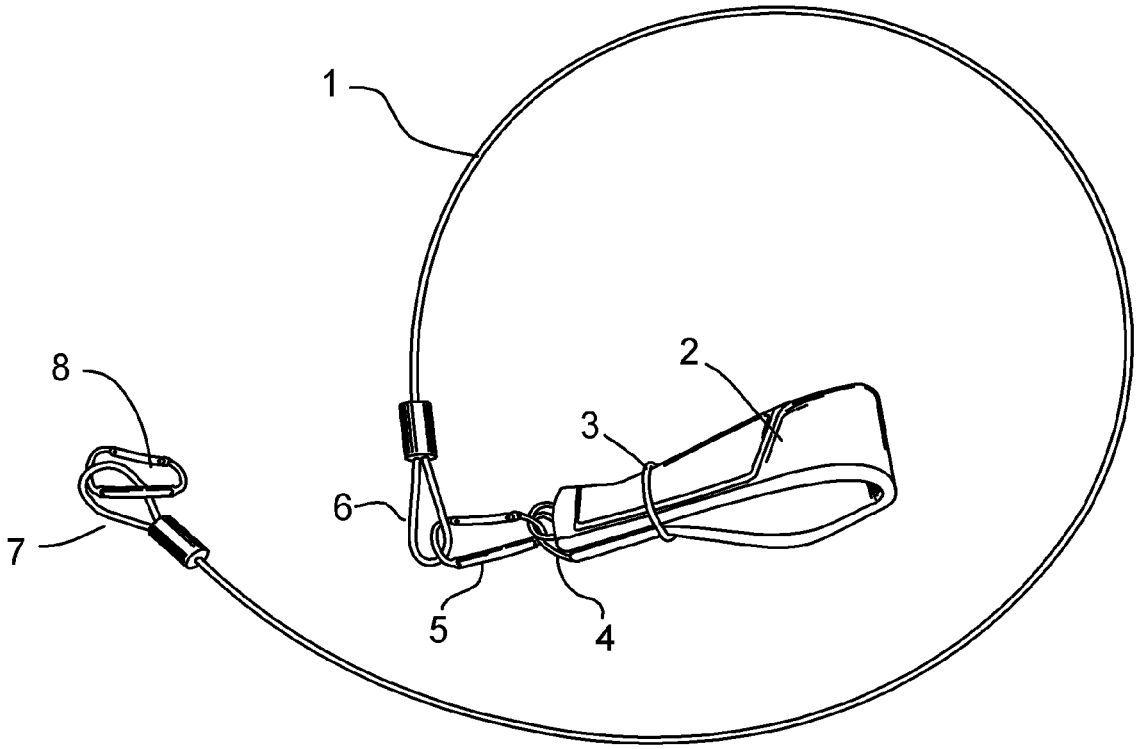
FIG. 2 shows the embodiment of FIG. 1 with the cable coiled.

FIG. 2 shows an embodiment of the invention. A steel cable 1 (or any other strong material) can be plastic coated (vinyl preferred). An ideal size is 3/16 inch cable bare which is approximately ¼ inch in diameter when coated. One end of the cable is looped 7 and can be equipped with a carabiner hook 8 for easy fastening to solid anchor points. The other end can be attached to the cuff 2 with D-rings, or alternatively O-rings. These can pass through a stitched section of the cuff or through grommets (See FIG. 5). A sliding ring 3 allows tightening of the cuff 2. Another loop 6 in the cable 1 and another carabiner hook 5 allows easy attachment of the cable 1 to the cuff 2. An ideal length for the cable 2 is around 5 feet. Any length is within the scope of the present invention. While a single cable 1 is shown for example, multiple cables may also be used.

Figure 3:
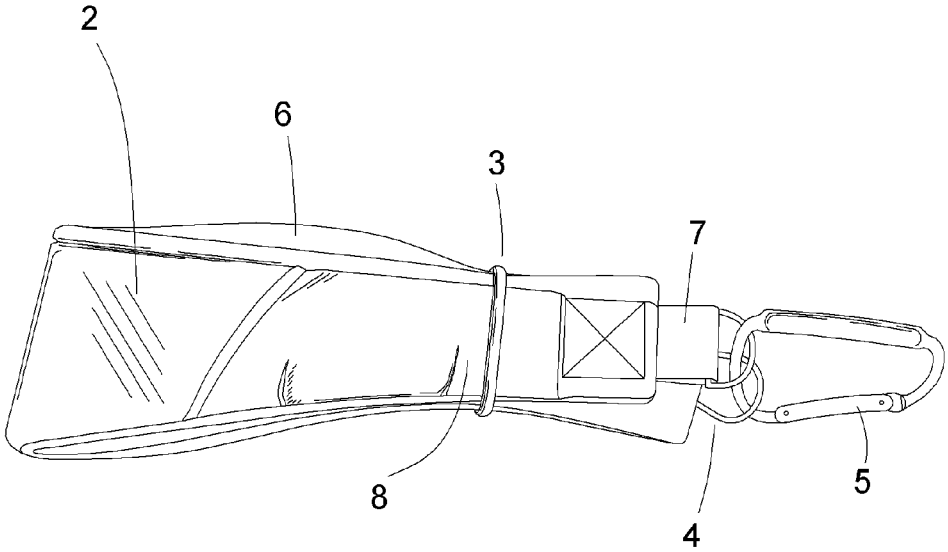
FIG. 3 shows a side view of a wrist cuff that uses sewed in D-rings.

FIG. 3 shows a side view of an embodiment of the cuff 2. An inner surface of the cuff that leads to a through-hole 6 for the wrist can be seen. A tightening ring 3 slides on a relatively flat tightening area 8 of the cuff to tighten it. D-rings 4 attach to the carabiner hook 5. The cuff 2 can also optionally have a front D-ring attachment. The preferred length of the cuff 2 is around 18-20 inches; the preferred height at the center is around 3-4 inches with a height of around 1-2 inches at the ends. While these dimensions are given for example, any dimensions of the cuff are within the scope of the present invention.

Figure 4:
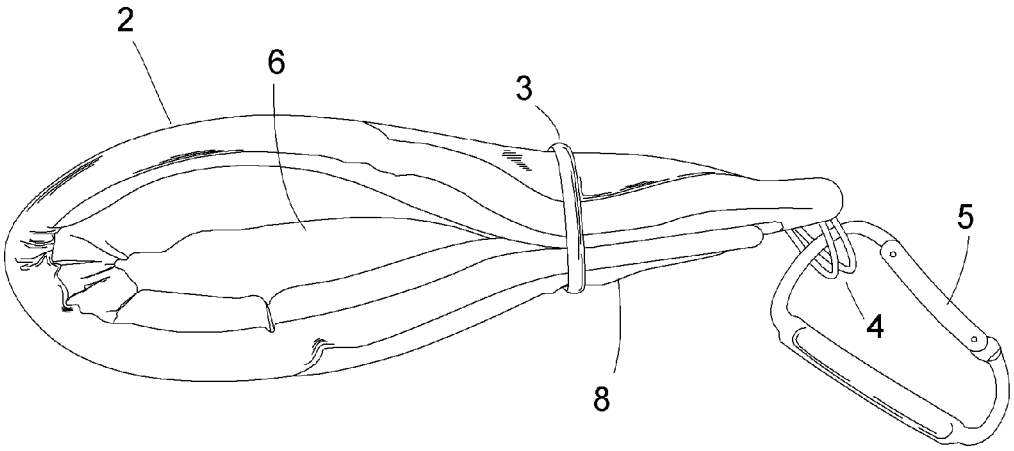
FIG. 4 shows a top view of the wrist cuff of FIG. 3

FIG. 4 shows a top view of the cuff from FIG. 3. Here, the through-hole 6 of the cuff 2 can be clearly seen. Again, the tightening ring 3 and the tightening area 8 are visible, as well as the D-rings 4 and the carabiner hook 5. The cuff 2 can have a material thickness of around ½ inch.

Figure 5:
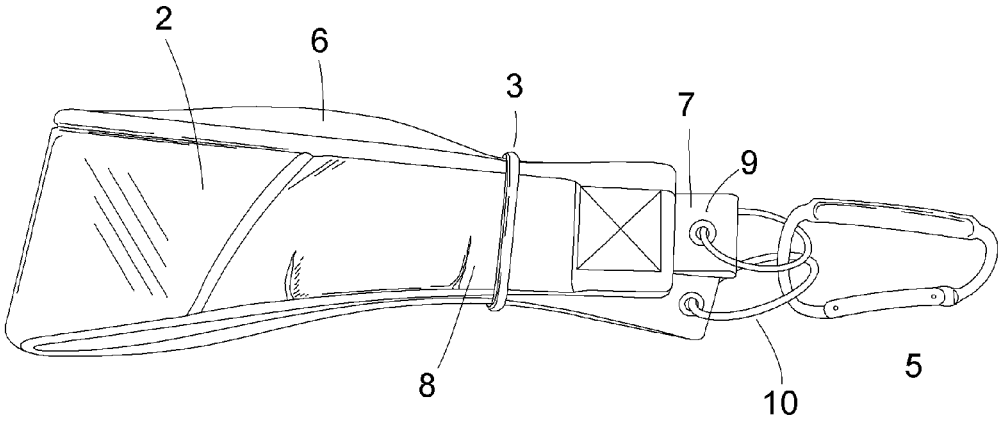
FIG. 5 shows an alternate embodiment of a wrist cuff using O-rings through grommets.

FIG. 5 shows a side view of an alternative embodiment of the cuff 2. Grommets 9 pass through the ends of the cuff. O-rings 10 are used instead of D-rings to engage the carabiner hook 5. While carabiner hooks have been described, any type of hook or fastener can be used and is within the scope of the present invention. In particular, trigger snaps and hooks may also be used. Also, while removable hooks have been shown, the invention may also be used with fixed attachments.

The cuff 2 can be custom shaped to fit the contours of the wrist. An ankle strap can be rectangular in shape with hook-loop material attachments (such as VELCRO Registered Trademark). A security strap can also be provided. The cuff 2 can use padded felt-like inner material in order to feel comfortable with NYLON™ type material on the outside. Any weather and wear resistant material is within the scope of the present invention.

Figure 6:
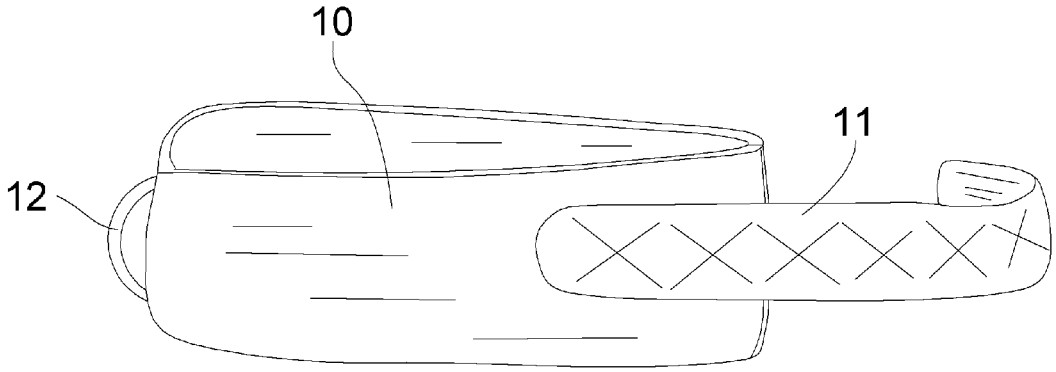
FIG. 6 shows an embodiment of an ankle cuff.

FIG. 6 shows an embodiment of an ankle cuff 10. The preferred width is around 4 inches. The cuff can have a thickness of around ½ inch. A hook/loop strap 11 (such as VELCRO™) 11 starting can secure the device by on a side by wrapping around the cuff 10. A ring 12 in the front is used to attach the cuff to the cable 1.

The present invention includes a developed handle or cuff that allows the user to relax the intrinsic muscles while still obtaining a more than sufficient stretch using body weight without having to hold onto something. Anyone who wishes to gain flexibility in an upper or lower extremity can benefit from the present invention.

The present invention can be used for any type of sports training and/or rehabilitation, some weight-loss exercises and/or general stretching exercise. It can be used anywhere a secure anchor point can be found (which is almost anywhere). The invention is small, coils up, and is easily stored or carried. A bag or pouch can be used to hold it when not being used. Various sports such as badminton, baseball, basketball, bowling, football, golf, gymnastics, lacrosse, martial arts, racquetball, softball, tennis, track and field and numerous other sports can benefit from use of the present invention. In rehabilitation, the invention can be used for adhesion, arthritis, capsulitus, carpel tunnel, epicondylitis, general stretching, impingement, pre/post operative, sprains, strains, pulled tendons and many other types of rehabilitation.

Several descriptions and drawings have been presented to aid in understanding the present invention. One with skill in the art will realize that numerous changes and variations are possible without departing from the spirit of the invention. Each of these changes and variations is within the scope of the present invention.

We claim:

1. A stretch apparatus comprising:

an exercise apparatus including a non-extendable metal cable, said cable having closed attachment loops on each end;

a cuff, said cuff being adapted to be worn on a human extremity, said cuff having a tightening ring, and at least one attachment ring, wherein said cuff is a wrist cuff;

a first removable clip on a first of said loops attaching said cable to said attachment ring on said cuff;

a second removable clip on a second of said loops allowing said cable to be fixidly secured to a fixed anchor point, whereby a user can perform stretch exercises.

2. A stretch apparatus comprising:

an exercise apparatus including a non-extendable metal cable, said cable having closed attachment loops on each end;

a cuff, said cuff being adapted to be worn on a human extremity, said cuff having tightening ring, and at least one attachment ring wherein said cuff is an ankle cuff;

a first removable clip on a first of said loops attaching said cable to said attachment ring on said cuff;

a second removable clip on a second of said loops allowing said cable to be fixidly secured to a fixed anchor point, whereby a user can perform stretch exercises.

3. A stretch exercise apparatus comprising:

a stretch exercise apparatus including a non-extendable steel cable, said cable having closed attachment loops on each end;

a cuff, said cuff being adapted to be worn on a human arm, said cuff having a tightening ring, and at least one attachment ring, wherein said cuff is a wrist cuff;

a first removable clip on a first of said loops attaching said cable to said attachment ring on said cuff;

a second removable clip on a second of said loops allowing said cable to be fixidly secured to a fixed anchor point, whereby a user can perform stretch exercises.

4. A stretch exercise apparatus comprising:

a stretch exercise apparatus including a non-extendable steel cable, said cable having closed attachment loops on each end;

a cuff, said cuff being adapted to be worn on a human leg, said cuff having a tightening ring, and at least one attachment ring, wherein said cuff is an ankle cuff;

a first removable clip on a first of said loops attaching said cable to said attachment ring on said cuff;

a second removable clip on a second of said loops allowing said cable to be fixidly secured to a fixed anchor point, whereby a user can perform stretch exercises.

* * * * *